US006094791A

United States Patent [19]

Akase et al.

[11] Patent Number: 6,094,791

[45] Date of Patent: Aug. 1, 2000

[54] METHOD AND APPARATUS FOR OPENING REINFORCING FIBER BUNDLE AND METHOD OF MANUFACTURING PREPREG

[75] Inventors: Daisaku Akase, Iyo; Hidetaka Matsumae, Otsu; Tohru Hanano, Kawasaki; Toshihide Sekido, Otsu, all of Japan

[73] Assignee: Toray Industries, Inc., Japan

[21] Appl. No.: 09/202,011

[22] PCT Filed: Dec. 10, 1997

[86] PCT No.: PCT/JP97/04541

§ 371 Date: Dec. 18, 1998

§ 102(e) Date: Dec. 18, 1998

[87] PCT Pub. No.: WO98/45515

PCT Pub. Date: Oct. 15, 1998

[30] Foreign Application Priority Data

Apr. 10, 1997 [JP] Japan ..... 9-092101

[51] Int. Cl.[7] ..... D01D 11/02

[52] U.S. Cl. ..... 28/282; 19/65 T

[58] Field of Search ..... 28/282, 283, 220, 28/219; 19/65 T, 66 T; 26/99, 100

[56] References Cited

U.S. PATENT DOCUMENTS

| | | | |
|---|---|---|---|
| 3,145,429 | 8/1964 | Resor | 28/282 |
| 3,840,941 | 10/1974 | Neven | 28/282 |
| 3,865,565 | 2/1975 | Spence et al. | 28/282 |
| 4,301,579 | 11/1981 | Van Den Hoven | 28/282 |
| 4,959,895 | 10/1990 | Sager | 28/282 |
| 5,042,122 | 8/1991 | Iyer et al. | 28/282 |
| 5,108,678 | 4/1992 | Hirasaka et al. | 28/282 |

FOREIGN PATENT DOCUMENTS

| | | | |
|---|---|---|---|
| 1258313 | 1/1968 | Germany | 28/282 |
| 45-35382 | 11/1970 | Japan | 28/282 |
| 61-275438 | 12/1986 | Japan | 28/282 |
| 5-140815 | 6/1993 | Japan . | |
| 9-85744 | 3/1997 | Japan . | |
| 218370 | 12/1968 | Russian Federation | 28/282 |

*Primary Examiner*—Amy B. Vanatta
*Attorney, Agent, or Firm*—Austin R. Miller

[57] ABSTRACT

The present invention provides a method and apparatus, in which a reinforcing fiber bundle consisting of a plurality of paralleled single fibers is or a plurality of mutually paralleled reinforcing fiber bundles respectively consisting of a plurality of paralleled single fibers are driven to run through a plurality of rolls while being bent to open the fiber, and in which the opened reinforcing fiber bundle is impregnated with resin to produce a prepreg, comprising vibrating at least one of the rolls in the axial direction of the roll, to open the reinforcing fiber bundle(s), pressing the reinforcing fiber bundle(s) to the peripheral surface of a roll located immediately downstream of the vibrating roll without vibrating the roll, and bringing the opened reinforcing fiber bundle(s) into contact with the peripheral surface of the non-vibrating roll with a contact length of not less than twice the contact length of the reinforcing fiber bundle(s) on the vibrating roll, for retaining the opened state of the reinforcing fiber bundle (s). The present invention allows the reinforcing fiber bundle (s) to be opened stably with little fuzzing caused, for producing a uniform and thin reinforcing fiber sheet, and from the uniform and thin reinforcing fiber sheet, a uniform and thin crack-less prepreg with a good grade can be obtained.

56 Claims, 4 Drawing Sheets

METHOD AND APPARATUS FOR OPENING REINFORCING FIBER BUNDLE AND METHOD OF MANUFACTURING PREPREG

TECHNICAL FIELD

The present invention relates to a method and apparatus for opening a reinforcing fiber bundle, and a method for manufacturing a prepreg, and particularly to a method and apparatus for continuously opening a reinforcing fiber bundle consisting of a plurality of paralleled single fibers or a plurality of mutually paralleled and simultaneously running reinforcing fiber bundles, and a method for manufacturing a yarn prepreg or sheet prepreg by impregnating the opened reinforcing fiber bundle(s) with a resin.

BACKGROUND ARTS

In recent years, prepregs in which reinforcing fibers are impregnated with a matrix resin are broadly used in various industrial fields. For example, sheet prepregs respectively obtained by paralleling a plurality of reinforcing fiber bundles respectively consisting of a plurality of paralleled single fibers such as carbon fibers or glass fibers, and impregnating them with a thermosetting resin such as an epoxy resin or unsaturated polyester resin, etc. are being widely used as general industrial materials such as aircraft materials and automobile materials, and also as medical materials and formed materials for sports and leisure like fishing rods, golf club shafts, badminton rackets, tennis rackets, etc.

Since the applications of prepregs are diversified like this, there are growing demands for thinner prepregs and prepregs using thermoplastic resins, and the necessity of improving the grade of prepregs, that is, producing more uniform prepregs with less thickness irregularity has grown. To meet these demands and requirements, it is necessary to open the reinforcing fiber bundle before impregnating it with a matrix resin when forming a prepreg, for reducing the thickness of the reinforcing fiber bundle and for letting the matrix resin sufficiently fill the clearances between the single fibers of the reinforcing fiber bundle.

In the production of a prepreg, one of the reasons why the opening of reinforcing fiber bundles is necessary is cost reduction. To produce a uniform and thin prepreg, generally thin reinforcing fiber bundles or reinforcing fiber bundles small in the number of component filaments are paralleled in one direction to produce a thin prepreg. However, since thin reinforcing fiber bundles or reinforcing fiber bundles small in the number of component filaments are generally expensive, it is advantageous to open reinforcing fiber bundles as thick as possible or as large as possible in the number of component filaments for forming a thin reinforcing fiber sheet and to manufacture a prepreg using the sheet. That is, if thick reinforcing fiber bundles or reinforcing fiber bundles large in the number of component filaments are opened to produce a thin prepreg with a conventional thickness, a desired prepreg can be produced at a lower cost.

Thus, the technique for efficiently opening the raw reinforcing fiber bundles is important among the techniques for producing a prepreg from reinforcing fiber bundles. As methods for opening reinforcing fiber bundles, for example, the following techniques are known.

(1) A method for feeding reinforcing fiber bundles at a speed of 0.04 m/s or less for letting them run on a round rod or revolving roll vibrated in the axial direction (Japanese Patent Laid-Open (Kokai) No. 56-43435)

(2) A method for feeding reinforcing fiber bundles at about 1 m/s for letting them run on a roll vibrated in the revolving axis direction for vibrating the reinforcing fiber bundles with tension (an example described in Japanese Patent Laid-Open (Kokai) No. 2-36236).

In such conventional methods, for example as shown in FIG. 6, the reinforcing fiber bundles 102 unwound from packages 101 to run in parallel to each other are fed through a comb 103, to be regulated in fiber bundle intervals, and pressed against a roller 105 vibrated in the axial direction by an excitation source 104, to rub the reinforcing fiber bundles 102 in the width direction for opening them.

Furthermore, the following techniques are also known.

(3) A method for letting reinforcing fiber bundles run on several round rods or revolving rolls arranged at angles of 30 to 90° (Japanese Patent Publication No. 3-31823)

(4) A method for bringing a round rod ultrasonically vibrated in the axial direction into contact with reinforcing fiber bundles (Japanese Patent Laid-Open (Kokai) No. 1-282362)

(5) A method for heating reinforcing fiber bundles for removing or reducing the sizing agent deposited in them (Japanese Patent Publication No. 3-25540)

(6) A method for bringing a round rod heated to 50 to 200° C. into contact with reinforcing fiber bundles (Japanese Patent Laid-Open (Kokai) No. 3-146735)

(7) A method for opening reinforcing fiber bundles using a water stream (Japanese Patent Laid-Open (Kokai) No. 52-151362) and so on.

However, the inventors found that even if any of the above prior arts is employed, if each reinforcing fiber bundle to be opened has its filaments entangled or remains twisted, the fiber bundle once opened on a vibrated roll has the filaments bundled again due to tension at a certain point downstream of the roll, returning the width of the fiber bundle to almost the same width as that before opening. If such fiber bundles are impregnated with a resin later, the prepreg obtained has portions not impregnated with the matrix resin and cannot be practically used. Furthermore, in the conventional methods of vibrating a roll as described above, the apparatus as a whole is heavily vibrated and cannot withstand the operation for a long time.

On the other hand, individual reinforcing fibers are generally given a sizing agent such as an epoxy resin, to be improved in handling convenience, for the reason that they are likely to be broken and frequently fuzzed since they are high in elastic modulus and small in diameter. The sizing agent functions as a "glue", to bond the single fibers mutually, and prevents the fiber bundle from being opened. Therefore, unless any means is taken to allow opening against the bonding strength of the sizing agent, the improvement of openability cannot be expected.

The above-described respective prior arts (1) to (7) are respectively examined below in more detail. The method (1) of feeding reinforcing fiber bundles at a speed of 0.04 m/s or less for letting them run on a round rod vibrated in the axial direction has a problem that if the reinforcing fiber bundles are driven to run at a high speed of 0.08 to 0.50 m/s, the reinforcing fiber bundles are abraded by the round rod, to be fuzzed. The method also has a problem that when a revolving roller is installed, the opened width is small usually when the reinforcing fiber bundle supply speed is high, not allowing the intended effect to be obtained.

The method (2) of feeding reinforcing fiber bundles at about 0.02 m/s for letting them run on a roll vibrated in the revolving axis direction for vibrating the reinforcing fiber bundles with tension has a problem that if the reinforcing fiber bundles are driven to run at a high speed of 0.08 to 0.50 m/s, the reinforcing fiber bundles are likely to be abraded more than in the above method (1) because of vibration with tension, being fuzzed more.

The method (3) of bringing reinforcing fiber bundles into contact with several round rods arranged at angles of 30 to 900 has a problem that if the reinforcing fiber bundles are brought into contact at a high speed of 0.08 to 0.50 m/s, abrasion causes fuzzing. Furthermore, the method has a problem of space since if revolving rolls are used, very many revolving rolls are necessary because of a small opening effect.

In the method (4) of bringing reinforcing fiber bundles into contact with a round rod ultrasonically vibrated in the axial direction, if the round rod is brought into contact with the reinforcing fiber bundles at a speed of 0.08 to 0.50 m/s, the opened width is small to decrease the effect. Furthermore, the method has a problem that the reinforcing fiber bundles are abraded by a round rod, to be fuzzed, since the round rod is vibrated ultrasonically.

In the method (5) of heating reinforcing fiber bundles for decreasing or removing the sizing agent deposited in them, the equipment for treating the sizing agent removed from the reinforcing fiber bundles is necessary to raise the equipment cost. Especially when the reinforcing fiber bundles are supplied at a high speed of 0.08 to 0.50 m/s, the heating zone must be longer, to further raise the equipment cost.

The method (6) of bringing reinforcing fiber bundles into contact with a round rod heated to 50 to 200° C. has a problem that since the round rod is directly heated, the supply of reinforcing fiber bundles for a long time causes the sizing agent to stick to the round rod, to cause fuzzing.

The method (7) of opening reinforcing fiber bundles using a water stream has a problem of waste water treatment since the water containing the sizing agent must be discharged, raising the equipment cost. Furthermore, the equipment and energy for drying are necessary unpreferably in view of economy.

DISCLOSURE OF THE INVENTION

An object of the present invention is to provide a reinforcing fiber bundle opening method and apparatus which allow a reinforcing bundle consisting of single fibers entangled with each other or remaining twisted, to be opened easily at a high speed without causing fuzzing, and which allow even a fiber bundle with a sizing agent deposited to be sufficiently opened and allows the opened width to be retained, and furthermore to provide a method for manufacturing a desired uniform and thin prepreg stably using the opened reinforcing fiber bundle.

To achieve the object, a method for opening a reinforcing fiber bundle according to the present invention, in which a reinforcing fiber bundle consisting of a plurality of paralleled single fibers is driven to run through a plurality of rolls which being bent, comprises (a) vibrating at least one of the plurality of rolls in the axial direction of the roll, (b) pressing the reinforcing fiber bundle onto the peripheral surface of a roll located immediately downstream of the vibrating roll, without vibrating the roll, and (c) bringing the reinforcing fiber bundle into contact with the peripheral surface of the non-vibrating roll with the contact length of not less than twice the contact length of the reinforcing fiber bundle on the peripheral surface of the vibrating roll.

As another version, a method for opening a reinforcing fiber bundle according to the present invention, in which a reinforcing fiber bundle consisting of a plurality of paralleled single fibers is driven to run through a plurality of rolls while being bent, comprises arranging 2 to 10 pairs of rolls, each pair consisting of a vibrating free revolving roll vibrated in the axial direction of the roll and a non-vibrating free revolving roll, with the diameters of the vibrating free revolving roll kept in a range of 20 to 50 mm, with the diameters of the non-vibrating free revolving roll kept in a range of 50 to 120 mm, and with the distance between each of the vibrating free revolving rolls and its mating non-vibrating free revolving roll kept in a range of 10 to 100 mm as the length of the reinforcing fiber bundle segment not in contact with either of the rolls, and letting the reinforcing fiber bundle run through the vibrating free revolving rolls and the non-vibrating free revolving rolls alternately.

The reinforcing fiber bundle in the present invention may be one fiber bundle consisting of a plurality of paralleled single fibers, or a plurality of mutually paralleled fiber bundles respectively consisting of a plurality of paralleled single fibers, arranged like a sheet.

In the present invention, "the non-vibrating roll located immediately downstream of the vibrating roll" means the non-vibrating roll located with a distance of 100 mm or less kept from the vibrating roll as the free length of the fiber bundle running between the rolls (the length of the fiber bundle not in contact with either of the rolls). If the distance is more than 100 mm, the effect of opening the fiber bundle by the vibration of the roll and the effect of retaining the opened width become small.

It is preferable that the contact length of the reinforcing fiber bundle in contact with the non-vibrating roll is in a range of 2 to 10 times the contact length of the reinforcing fiber bundle on the peripheral surface of the vibrating roll. Further, it is preferable to open the reinforcing fiber bundle while softening the sizing agent deposited in the reinforcing fiber bundle by heating the reinforcing fiber bundle, for example, by heating the fiber contact surface of at least either the vibrating roll or the non-vibrating roll. A preferable heating temperature range is 50 to 180° C., and a more preferable range is 70 to 140° C. A preferable vibration frequency range of the vibrating roll is 1 to 100 Hz, and a more preferable range is 3 to 60 Hz. A preferable amplitude range is 1 to 50 mm, and a more preferable range is 1 to 30 mm. The reinforcing fiber bundle running speed is set, for example, in a range of 0.08 to 0.50 m/s. It is preferable that two or more pairs of rolls, each pair consisting of the vibrating roll and the non-vibrating roll, are provided, and that the plurality of vibrating rolls may be set at respectively different values at least in either vibration frequency or amplitude. It is also preferable that one vibrating roll is vibrated in the direction reverse to that of the vibrating roll located downstream of it.

In the present invention, the vibrating roll supports the reinforcing fiber bundle and is vibrated in the axial direction of the roll, that is, in the direction perpendicular to the running direction of the reinforcing fiber bundle, to open the reinforcing fiber bundle, and may be either capable of freely revolving around the axis or fixed. It is desirable that the outer diameter of the vibrating roll is as small as possible in view of opening effect, specifically 50 mm or less. The non-vibrating roll retains the opened width of the reinforcing fiber bundle opened by the vibrating roll, and it may also be either capable of freely revolving around its axis or fixed. However, to keep the abrasion of the reinforcing fiber bundle small for inhibiting fuzzing, it is preferable that both the vibrating roll and the non-vibrating roll are capable of freely revolving.

The reinforcing fibers used to form the reinforcing fiber bundle are not particularly limited, and in the present invention, any reinforcing fibers such as carbon fibers, glass fibers or aramid fibers can be applied. The present invention is especially suitable for a carbon fiber bundle.

The apparatus for opening a reinforcing fiber bundle according to the present invention, which has a plurality of rolls through which a reinforcing fiber bundle consisting of a plurality of paralleled single fibers is driven to run while being bent, and an exciting means for vibrating at least one of the plurality of rolls in the axial direction of the roll, comprises (a) a roll located immediately downstream of the vibrating roll vibrated by said exciting means, being not vibrated, and (b) said non-vibrating roll, having a peripheral surface with the contact length kept at not less than twice the contact length of the reinforcing fiber bundle on the peripheral surface of the vibrating roll.

As another version, the apparatus for opening a reinforcing fiber bundle according to the present invention, which has a plurality of rolls through which a reinforcing fiber bundle consisting of a plurality of paralleled single fibers is driven to run while being bent, comprises (a) the plurality of rolls, being provided as 2 to 10 pairs of rolls, each pair consisting of a vibrating free revolving roll vibrated in the axial direction of the roll and a non-vibrating free revolving roll, and (b) the diameters of the vibrating free revolving rolls in the respective pairs, being kept in a range of 20 to 50 mm, the diameters of the non-vibrating free revolving rolls, being kept in a range of 50 to 120 mm, and the distance between each of the vibrating free revolving rolls and its mating non-vibrating free revolving roll, being kept in a range of 10 to 100 mm as the length of the reinforcing fiber bundle segment not in contact with either of the rolls.

In the apparatus for opening a reinforcing fiber bundle, it is preferable that a free revolving roll with a plurality of ridges extending in the axial direction of the roll on the surface is provided upstream and/or downstream of the vibrating free revolving rolls. It is also preferable that the height (t) of the ridges of the free revolving roll with ridges on the surface exceeds $r(1/\cos(\theta/2)-1)$, where r is the radius of the roll, and that the angle ($\theta$) formed between the respectively adjacent ridges in reference to the axial center of the roll is in a range of 10 to 50°.

The method for manufacturing a prepreg according to the present invention uses the above mentioned reinforcing fiber bundle opening method.

Namely, a method for manufacturing a prepreg according to the present invention, in which a reinforcing fiber bundle consisting of a plurality of paralleled single fibers is, or a plurality of mutually paralleled reinforcing fiber bundles respectively consisting of a plurality of paralleled single fibers are driven to run through a plurality of rolls while being bent, and the opened reinforcing fiber bundle(s) is (are) impregnated with a resin to manufacture a prepreg, comprises (a) vibrating at least one of the plurality of rolls in the axial direction of the roll for opening the reinforcing fiber bundle(s), (b) pressing the reinforcing fiber bundle(s) to the peripheral surface of the roll located immediately downstream of the vibrating roll, without vibrating the roll, (c) bringing the reinforcing fiber bundle(s) into contact with the peripheral surface of the non-vibrating roll with the contact length kept at not less than twice the contact length of the reinforcing fiber bundle(s) on the peripheral surface of the vibrating roll, for retaining the opened state of the reinforcing fiber bundle(s) and (d) impregnating the reinforcing fiber bundle(s) with the opened state retained, with a resin.

As another version, a method for manufacturing a prepreg according to the present invention, in which a reinforcing fiber bundle consisting of a plurality of paralleled single fibers is, or a plurality of mutually paralleled reinforcing fiber bundles respectively consisting of a plurality of paralleled single fibers are driven to run through a plurality of rolls while being bent, and the opened reinforcing fiber bundle(s) is (are) impregnated with a resin to manufacture a prepreg, comprises (a) arranging 2 to 10 pairs of rolls, each pair consisting of a vibrating free revolving roll vibrated in the axial direction of the roll and a non-vibrating free revolving roll, with the diameters of the vibrating free revolving rolls kept in a range of 20 to 50 mm, with the diameters of the non-vibrating free revolving rolls kept in a range of 50 to 120 mm, and with the distance between each of the vibrating free revolving rolls and its mating non-vibrating free revolving roll kept in a range of 10 to 100 mm as the length of the reinforcing fiber bundle segment not in contact with either of the rolls, and letting the reinforcing fiber bundle(s) run through the vibrating free revolving rolls and the non-vibrating free revolving rolls alternately, for opening the reinforcing fiber bundle(s), and (b) impregnating the opened reinforcing fiber bundle(s) with a resin.

Moreover, the present invention also provides a prepreg manufacturing apparatus used for executing the above methods.

Namely, an apparatus for manufacturing a prepreg, which has a plurality of rolls through which a reinforcing fiber bundle consisting of a plurality of paralleled single fibers is or a plurality of mutually paralleled reinforcing fiber bundles respectively consisting of a plurality of paralleled single fibers are driven to run while being bent, an exciting means for vibrating at least one of the plurality of rolls in the axial direction of the roll, and a resin impregnating means for impregnating the reinforcing fiber bundle(s) coming out of the plurality of rolls, with a resin, comprises (a) a roll located immediately downstream of the roll vibrated by the exciting means, being not vibrated, and (b) the non-vibrating roll, having a peripheral surface with the contact length kept at not less than twice the contact length of the reinforcing fiber bundle(s) on the peripheral surface of the vibrating roll.

As another version, an apparatus for manufacturing a prepreg, which has a plurality of rolls through which a reinforcing fiber bundle consisting of a plurality of paralleled single fibers is or a plurality of mutually paralleled reinforcing fiber bundles respectively consisting of a plurality of paralleled single fibers are driven to run while being bent, and a resin impregnating means for impregnating the reinforcing fiber bundle(s) coming out of the plurality of rolls, with a resin, comprises (a) the plurality of rolls, being provided as 2 to 10 pairs of rolls, each pair consisting of a vibrating free revolving roll vibrated in the axial direction of the roll and a non-vibrating free revolving roll, and (b) the diameters of the vibrating free revolving rolls in the respective pairs, being in a range of 20 to 50 mm, the diameters of the non-vibrating free revolving rolls, being in a range of 50 to 120 mm, the distance between each of the vibrating free revolving rolls and its mating non-vibrating free revolving roll, being in a range of 10 to 100 mm as the length of the reinforcing fiber bundle segment not in contact with either of the rolls.

THE BEST MODE FOR CARRING OUT THE INVENTION

Desirable embodiments of the present invention will be described below in reference to the drawings.

Figure 1:
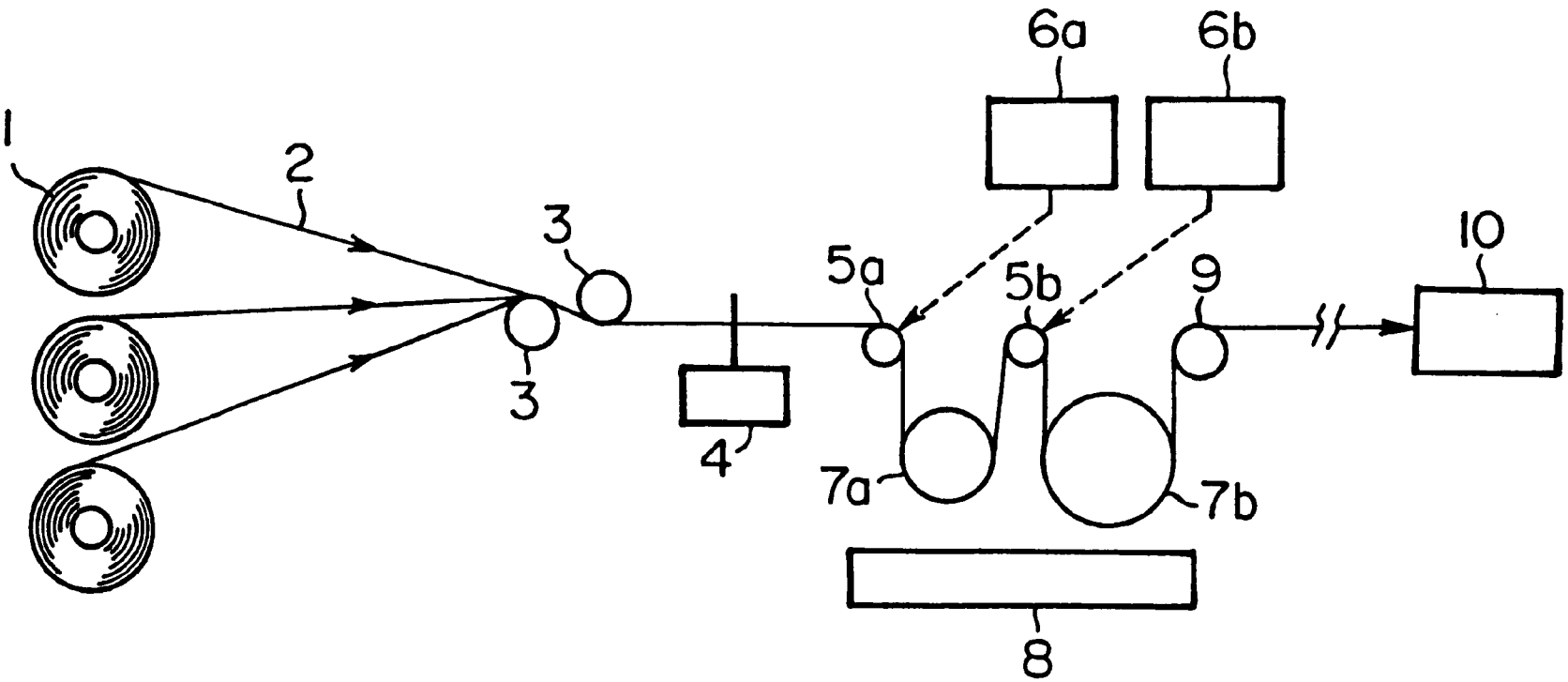
FIG. 1 is a schematic view of a fiber bundle opening section of a prepreg manufacturing apparatus applied with a reinforcing fiber bundle opening method and a prepreg manufacturing method according to an embodiment of the present invention.
Figure 2:
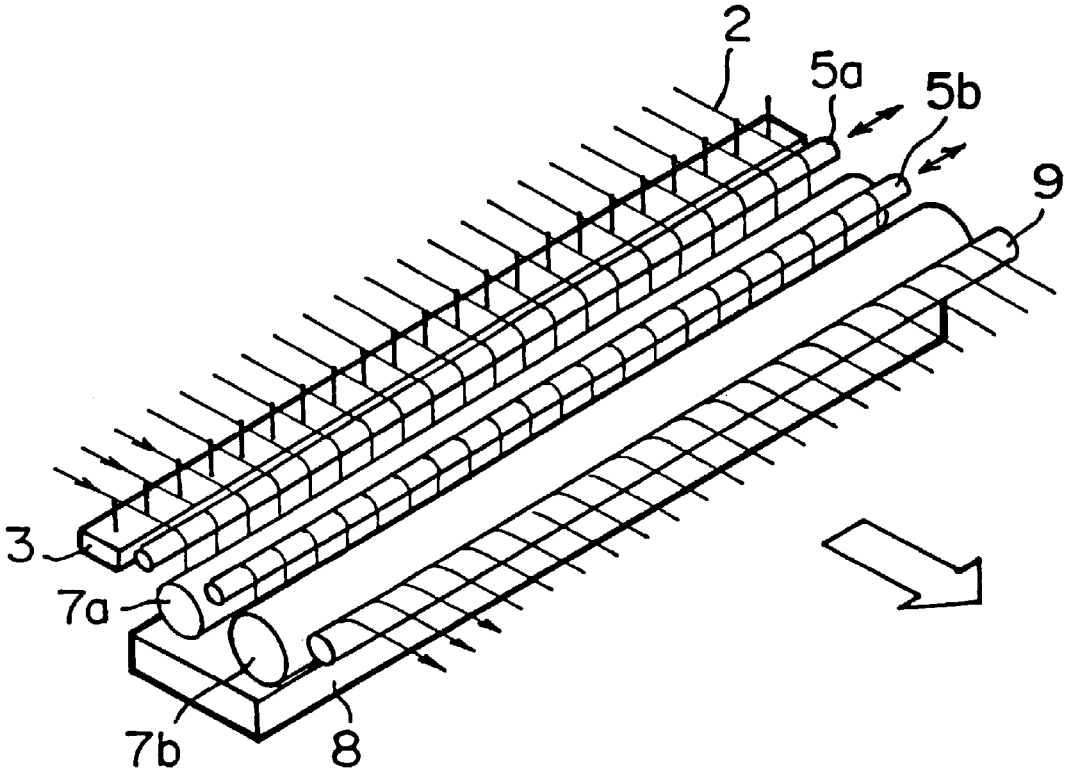
FIG. 2 is an enlarged partial perspective view of the apparatus shown in FIG. 1.

FIG. 1 shows the fiber bundle opening section of a prepreg manufacturing apparatus applied with a reinforcing fiber bundle opening method and a prepreg manufacturing method according to an embodiment of the present invention. FIG. 2 shows a part of the apparatus shown in FIG. 1.

In FIG. 1, a plurality of reinforcing fiber bundles 2 respectively consisting of a plurality of paralleled reinforcing fibers such as carbon fibers or glass fibers are unwound from wound packages 1 and paralleled to each other by paralleling free revolving rolls 3. The plurality of reinforcing fiber bundles 2 are arranged by a comb 4 at regular intervals as shown in FIG. 2.

Vibrating rolls 5*a* and 5*b* are vibrated in the axial direction of the rolls, i.e., in the direction perpendicular to the running direction of the fiber bundles 2 by excitation sources 6*a* and 6*b*. As the excitation sources 6*a* and 6*b*, can be used known electromagnetic vibration exciters or mechanical exciters using a cam, etc. Each of the excitation sources 6*a* and 6*b* is provided with an adjusting means for adjusting the vibration frequency and amplitude respectively, though not illustrated.

The vibrating rolls 5*a* and 5*b* support the reinforcing fiber bundles 2 and are vibrated in the direction perpendicular to the running direction as described above, to open the reinforcing fiber bundles 2. They may freely revolve around their axial centers or fixed. It is desirable that the outer diameters of the vibrating rolls 5*a* and 5*b* are as small as possible in view of opening effect, specifically 50 mm or less.

Immediately downstream of the respective vibrating rolls 5*a* and 5*b*, non-vibrating rolls 7*a* and 7*b* are provided to retain the opened widths of the fiber bundles 2 opened by the vibrating rolls 5*a* and 5*b*. The non-vibrating rolls 7*a* and 7*b* are provided to retain the opened fiber widths, and if they are vibrated like the vibrating rolls 5*a* and 5*b*, the opened fiber widths become unstable while fuzzing is promoted to give undesirable results. Therefore, it is important that they are fixed in the axial direction, without being vibrated. The non-vibrating rolls 7*a* and 7*b* may be freely revolved around their axes, driven or fixed. It is only required that the fiber bundles are pressed against the stationary or revolving curved surfaces at a moderate pressure, while being guided to run around the peripheral surfaces. Therefore, the curved surfaces are not limited to the rolls as illustrated, and may also be semi-cylindrical surfaces or curves of any other form. It is preferable that the curved surfaces are as large as possible in the contact length with the fiber bundles for retaining the opened fiber widths of fiber bundles. Therefore, it is preferable that the contact length between each of the non-vibrating rolls 7*a* and 7*b* and the fiber bundles 2 is in a range of 2 to 10 times the contact length between its mating vibrating roll 5*a* or 5*b* and the fiber bundles 2. Specifically, it is desirable that the contact length between each of the non-vibrating rolls and the fiber bundles is 50 mm or more, preferably 70 mm or more, more preferably 100 mm or more.

Furthermore, to minimize the narrowing of the opened widths of the reinforcing fiber bundles 2 in the regions between each the vibrating rolls 5*a* or 5*b* and its mating non-vibrating roll 7*a* or 7*b*, it is preferable that the segmental length of the fiber bundles 2 not in contact with either of the rolls is as short as possible. Specifically, it is desirable to install the non-vibrating rolls 7*a* and 7*b* for keeping the length preferably at 100 mm or less, more preferably at 70 mm or less, further more preferably at 50 mm or less, especially preferably at 20 mm or less.

If at least either of the vibrating rolls 5*a* or 5*b* and its mating non-vibrating roll 7*a* or 7*b* are provided as one pair, the effect of opening may be achieved, but if two or more pairs of rolls are used, the opening effect may be further enhanced.

Below the non-vibrating rolls 7*a* and 7*b*, a heating means 8 for heating the reinforcing fiber bundles 2 is provided. The heating means 8 is provided to heat the fiber contact surfaces of the vibrating rolls and the non-vibrating rolls for softening the sizing agent deposited in the reinforcing fiber bundles 2. Therefore, the heating means 8 may be a near infrared heater, mid infrared heater or far infrared heater, etc. as long as it has a capability to heat the reinforcing fiber bundles 2 to the softening point of the sizing agent. As another method, the vibrating rolls and the non-vibrating rolls may also have a heater embedded inside respectively, to be directly heated, and this method is also included in the heating means of the present invention. The heating temperature of the reinforcing fiber bundles 2 depends on the sizing agent used, but it is desirable that the temperature is in a range of 50 to 180° C., preferably 70 to 140° C.

Figure 3:
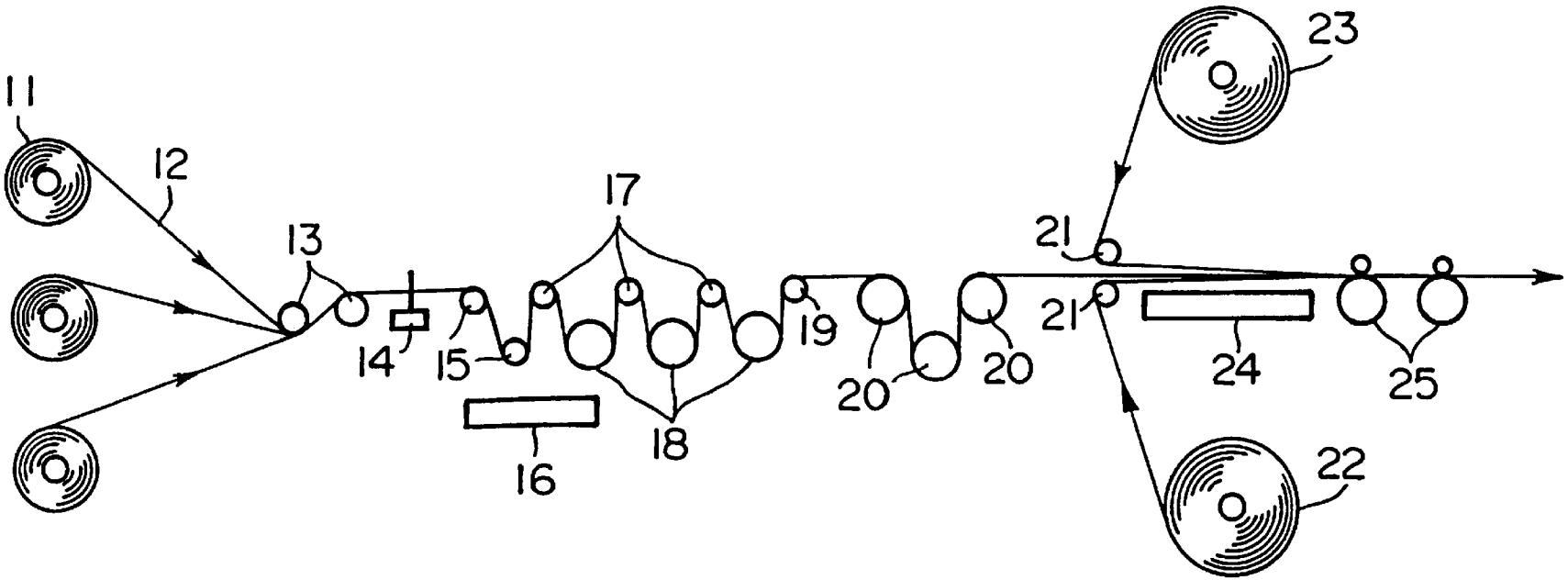
FIG. 3 is a schematic view of a prepreg manufacturing apparatus applied with a reinforcing fiber bundle opening method and a prepreg manufacturing method according to another embodiment of the present invention.

The reinforcing fiber bundles 2 taken up from a free revolving roll 9 at the outlet of the opening apparatus are sent to a take-up means 10 or a resin impregnating means as shown in FIG. 3 described later. The take-up means 10 may be a rotary drum forcibly revolved by any appropriate drive means such as a motor, or drive station, etc.

A preferable embodiment of the reinforcing fiber bundle opening method of the present invention is described below in reference to FIGS. 1 and 2.

It is preferable that the reinforcing fiber bundles 2 are unwound with a tension at the time of unwinding kept in a range of 0.1 to 5 N. If the tension is too high, opening is adversely affected, and if too low on the contrary, the fiber bundles sway. If the running speed of the reinforcing fiber bundles 2 is lower, the contact time with the vibrating rolls 5*a* and 5*b* and the non-vibrating rolls 7*a* and 7*b* can be kept longer advantageously, but even if the running speed is high, the contact time can be kept longer by increasing the number of pairs of rolls, each pair consisting of a vibrating roll and a non-vibrating roll.

It is preferable that the vibration frequencies of the vibrating rolls 5*a* and 5*b* are higher in a range of 1 to 100 Hz. However, in view of mechanical restriction, the vibration frequencies may be sufficient to be 3 to 30 Hz, or 5 to 20 Hz. It is preferable that the amplitudes of the vibrating rolls are also larger in a range of 1 to 50 mm, but in view of inhibiting the abrasion caused by vibration and the fuzzing caused by the abrasion, a range of 1 to 30 mm is more preferable, and a range of 5 to 20 mm is further more preferable.

FIG. 3 shows a prepreg manufacturing apparatus applying the reinforcing fiber bundle opening method and the prepreg manufacturing method according to another embodiment the present invention. In particular, it shows a prepreg manufacturing apparatus using carbon fiber bundles.

In FIG. 3, a plurality of carbon fiber bundles unwound from wound packages 11 are paralleled by paralleling free revolving rolls 13, fed through a comb 14, and supplied to introducing free revolving rolls 15. Below the introducing free revolving rolls 15, a heating source 16 is installed to heat the carbon fiber bundles 12. Subsequently, the carbon fiber bundles 12 are driven to run through three pairs of rolls, each pair consisting of a vibrating free revolving roll 17 and a non-vibrating free revolving roll 18, to be opened. At the outlet of the pairs of rolls, a free revolving roll 19 at the outlet of the opening apparatus is provided.

Downstream of the free revolving roll 19 at the outlet of the opening apparatus, tensioning rollers 20 are provided, so that the tension applied to the opened carbon fiber bundles 12 can be properly increased. On the carbon fiber bundles 12 formed like a sheet fed from the tensioning rolls 20, a bottom resin film 22 and a top resin film 23 are overlaid from both sides of the carbon fiber bundles 12 through resin film introducing free revolving rolls 21. The laminate is heated by a heating means 24, and pressed from both sides by impregnation rolls 25, to have a resin impregnated into the carbon fiber bundles 12, for forming a prepreg sheet.

The respective steps in the above prepreg production are described below in more detail.

In the above prepreg production, the apparatus for opening at least 10 or more paralleled carbon fiber bundles 12

(a) has an apparatus consisting of 2 to 10 pairs of rolls, each pair consisting of a vibrating free revolving roll 17 vibrated in the axial direction of the roll and a non-vibrating free revolving roll 18, and (b) the opening apparatus has the diameters of the vibrating free revolving rolls 17 kept in a range of 20 to 50 mm, the diameters of the non-vibrating free revolving rolls 18 kept in a range of 50 to 120 mm, and has the respective rolls arranged to keep a distance of 10 to 100 mm as the segmental length of the carbon fiber bundles 12 not in contact with either of the rolls 17 and 18 in each pair, so that the carbon fiber bundles 12 may be driven to run through the vibrating free revolving rolls 17 and the non-vibrating free revolving rills 18 alternately.

The number of pairs of rolls, each pair consisting of the vibrating free revolving roll 17 and the non-vibrating free revolving roll 18, is 2 to 10. A preferable range is 3 to 8 pairs. If one pair only is used, the effect of opening the carbon fiber bundles 12 running at a speed of 5 to 30 m/min can be little obtained. Even if 11 or more pairs are used, the opening effect cannot be improved so much, and the increased number of rolls raises the equipment cost unpreferably.

The diameters of the vibrating free revolving rolls 17 are 20 to 50 mm, and a preferable range is 25 to 45 mm. If the diameters of the rolls 17 are less than 20 mm, the contact angles of the carbon fiber bundles 12 become small, and even if the vibrating free revolving rolls 17 are vibrated, the opening effect can be little obtained. If the diameters of the rolls 17 exceed 50 mm, the contact lengths are so long that abrasion is likely to occur with fuzzing caused disadvantageously.

The diameters of the non-vibrating free revolving rolls 18 are 50 to 120 mm, and a preferable range is 60 to 100 mm. Since the carbon fiber bundles 12 are opened by the vibrating free revolving rolls 17 while being held by the non-vibrating free revolving rolls 18, it is preferable that the contact lengths around the non-vibrating free revolving rolls 18 are longer. If the diameters of the non-vibrating free revolving rolls 18 are less than 50 mm, the forces for holding the carbon fiber bundles are lower, and no sufficient opening effect can be obtained. Even if the diameters of the rolls are more than 120 mm, the required holding forces can be sufficiently obtained at diameters of 120 mm or less. So, the equipment cost is simply raised disadvantageously.

The distance in which the carbon fiber bundles 12 do not contact either of the rolls of each pair is 10 to 100 mm, and a preferable range is 20 to 70 mm. If the distance of no contact is less than 10 mm, the running of the carbon fiber bundles 12 is disturbed by the vibration of the vibrating free revolving rolls 17, to disturb the intervals between the respective fiber bundles 12, and when a prepreg is produced, cracking is caused. If the distance is more than 100 mm, the carbon fiber bundles 12 are vibrated at a smaller amplitude, to almost lose the opening effect and the opened width retaining effect.

In the above-described carbon fiber bundle opening apparatus, if a heating means 16 capable of preheating the carbon fiber bundles 12 is installed, the carbon fiber bundles 12 can be vibrated after the sizing agent deposited in them have been softened. Therefore, the opening effect may be further enhanced. The heating means 16 may be hot air blasting or heater. For efficiently heating the carbon fiber bundles 12, a near infrared heater, mid infrared heater or far infrared heater is preferable.

Figure 4:
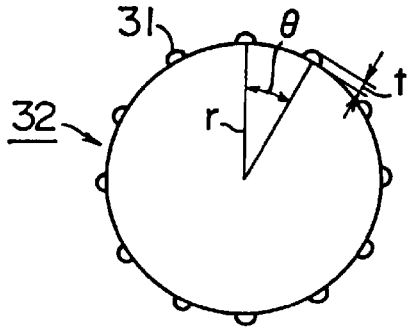
FIG. 4 is an enlarged schematic sectional view of a roll with ridges extending in the axial direction of the roll applicable to the apparatus shown in FIG. 3.
Figure 5A:
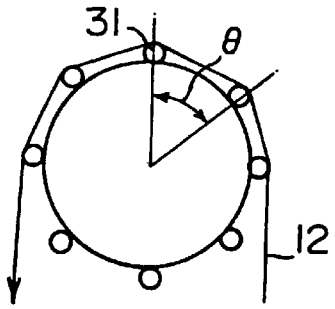
FIG. 5 is schematic sectional views of a roll for illustrating a preferable arrangement of the ridges of FIG. 4.
Figure 5B:
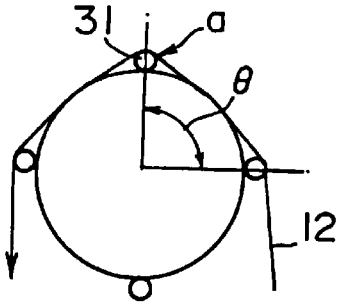

In the above-described carbon fiber bundle opening apparatus, it is preferable to install a free revolving roll 32 with ridges 31 extending in the axial direction of the roll as shown in FIG. 4 before the vibrating free revolving rolls 17. It is preferable that the height (t) of the ridges 31 of the free revolving roll 32 is larger than $r(1/\cos(\theta/2)-1)$, where r is the radius of the roll, and that the intervals of the ridges in the circumferential direction are decided to ensure that the angle ($\theta$) between the respectively adjacent ridges is kept in a range of 5 to 50°. Furthermore, it is preferable that a plurality of such free revolving rolls with ridges in the axial direction of each roll are provided, since a further uniform and thin carbon fiber bundle sheet can be obtained.

Usually, even carbon fiber bundles marketed as non-twisted bundles may remain twisted. The carbon fiber bundles, if twisted, move sideways, to disturb the intervals of the carbon fiber bundles, and if a prepreg is produced by using the carbon fiber bundle sheet, cracking may be caused. If a free revolving roll with ridges on the surface is used, the carbon fiber bundles can be held by the ridges, to prevent the movement in the axial direction of the roll otherwise caused by twisting, and the intervals can be kept constant, to allow the production of a crack-less prepreg.

The height (t) of the ridges 31 is more than $r(1/\cos(\theta/2)-1)$ to prevent the carbon fiber bundles 12 from contacting the roll surface as far as possible, while the angle ($\theta$) between the respectively adjacent ridges is kept in a range of 5 to 50°. It is more preferable that the angle is 10 to 40°. If the angle ($\theta$) between the respectively adjacent ridges 31 is less than 5°, the intervals of ridges are so narrow that the force for arresting the twisting becomes low, and if the angle (θ) exceeds 50° as shown in FIG. 4 (B), the radius of curvature at each ridge a becomes so large that fiber breaking and fuzzing of the carbon fiber bundles 12 are likely to be caused. So, the angle (θ) between the respectively adjacent ridges must be kept in a proper range of 5 to 50° as shown in FIG. 4 (A).

The free revolving roll 32 with the ridges 31 extending in the axial direction of the roll can be used, for example, as one of the introducing free rolls 15 shown in FIG. 3. The free revolving roll 32 with the ridges 31 can also be used as the free revolving roll 19 at the outlet of the carbon fiber bundle opening apparatus, to further inhibit the fluctuation in fiber disposition.

If the above carbon fiber bundle opening apparatus is provided with a mechanism for adjusting the amplitude and frequency of vibration respectively independently for allowing the opened widths of the carbon fiber bundles 12 to be adjusted, optimum opening conditions suitable for the carbon fiber bundles 12 used and the running speed of the carbon fiber bundles 12 can be obtained.

Furthermore, in the above carbon fiber bundle opening apparatus, if the number of the vibrating free revolving rolls 17 is n, and the n vibrating free revolving rolls are vibrated at an equal vibration frequency with the phase of vibration shifted by 360/n° each, to disperse and offset the vibration of the entire carbon fiber bundle opening apparatus, the apparatus can be higher in durability and the maintenance cost can be kept low.

Moreover, it is preferable that at least either the vibrating free revolving rolls 17 or the non-vibrating free revolving rolls 18 used in the above carbon fiber bundle opening apparatus are satin-finished at 3 S to 20 S in surface roughness. A more preferable surface roughness range is 6 S to 16 S. If the surface roughness is less than 3 S, the contact area of the carbon fiber bundles 12 on the surfaces of the rolls increases, causing the sizing agent to be transferred onto the roll surfaces, to contaminate them, and the fibers of the carbon fiber bundles 12 are likely to be caught and broken unpreferably. If the surface roughness exceeds 20 S, the roll surfaces become rugged, and the carbon fiber bundles 12 are likely to be flawed to cause fuzzing unpreferably. It is preferable that the introducing free revolving rolls 18 and the free revolving roll 19 at the outlet of the opening apparatus other than the vibrating free revolving rolls 17 and the non-vibrating free revolving rolls 18 are also satin-finished on the surfaces to have the above-mentioned surface roughness.

If the number of pairs of rolls, each pair consisitng of the vibrating free revolving roll 17 and the non-vibrating free revolving roll 18 is large, it is difficult to pass the carbon fiber bundles 12 through them. If either the vibrating free revolving rolls 17 or the non-vibrating revolving rolls 18 only can be lowered and elevated, the carbon fiber bundles 12 can be easily passed.

The carbon fiber bundle opening method according to the present invention uses the above opening apparatus. In this method, at least ten or more mutually paralleled carbon fiber bundles 12 are driven to run at 0.08 to 0.50 m/s, to be opened, and the carbon fiber bundle opening apparatus is used with the amplitudes of the vibrating free revolving rolls 17 kept in a range of 1 to 50 mm, preferably 1 to 30 mm, the vibration frequencies kept in a range of 1 to 100 Hz, preferably 3 to 60 Hz. In continuous opening, it is more preferable that the amplitudes are 3 to 25 mm and that the vibration frequencies 5 to 20 Hz, and it is especially preferable that the amplitudes are 5 to 20 mm and that the vibration frequencies are 5 to 17 Hz.

If the amplitudes are less than 1 mm and the vibration frequencies are less than 1 Hz, it is difficult to obtain the opening effect even when the carbon fiber bundles 12 are driven to run at a speed of 0.08 to 0.50 m/s. If the amplitudes exceed 50 mm and the vibration frequencies exceed 100 Hz, the carbon fiber bundles 12 are abraded by vibration, being likely to cause fuzzing unpreferably.

In the above carbon fiber bundle opening method, if the carbon fiber bundles 12 are heated to 50° C. to 180° C., preferably 70 to 140° C. to soften the sizing agent deposited in the carbon fiber bundles 12 before being introduced to run through the vibrating free revolving rolls 17 for vibration, the opening effect can be further enhanced. If the heating temperature is lower than 50° C., the sizing agent is softened poorly, to lower the opening effect. If higher than 180° C., the sizing agent is so softened as to be sticky, raising the friction coefficient, and fuzzing occurs at the vibrating free revolving rolls 12.

Furthermore, in the above carbon fiber bundle opening method, it is preferable that after the carbon fiber bundles 12 have been opened, the carbon fiber sheet (bundles) is controlled to have a tension of 0.05 to 0.80N per 1000 filaments. In this case, in the resin impregnation step, the excessive impregnation of the resin into the carbon fiber sheet is inhibited, and the resin remains on the carbon fiber sheet, to provide a prepreg with a good surface grade. If the tension is less than 0.05 N per 1000 filaments, the running of the uniformly paralleled carbon fiber bundles 12 is disturbed when the carbon fiber sheet is pressed in the impregnation step, and the intervals between carbon fiber bundles are disturbed, to cause cracking when a prepreg is produced. If the tension exceeds 0.80 N per 1000 filaments, the carbon fiber sheet once opened and paralleled has the single fibers to be bundled again by tension, to form clearances between the carbon fiber bundles, causing cracking when a prepreg is manufactured. Furthermore in such a impregnation step, the impregnation of the resin into the carbon fiber sheet is damaged, and portions not impregnated with the resin may be formed.

The carbon fiber bundles used in the present invention can consist, respectively, of 3,000 to 100,000 polyacrylonitrile or pitch based filaments. Especially when carbon fiber bundles respectively consisting of 12,000 to 100,000 filaments are used, a uniform and thin carbon fiber bundle sheet difficult to obtain by any conventional method can be obtained effectively. In the present invention, when ten or more such carbon fiber bundles are used, an especially large effect can be obtained.

As the matrix resin used in the prepreg production of the present invention, usually an epoxy resin is used. The epoxy resins which can be used here include, for example, bisphenol A type epoxy resin, phenol novolak type epoxy resin, cresol novolak type epoxy resin, glycidylamine type epoxy resin, alicyclic epoxy resin, urethane modified epoxy resin, brominated bisphenol A type epoxy resin, etc. Two or more of these epoxy resins can be used together, and any phase epoxy resins from liquid phase to solid phase can be used. Usually, the epoxy resin used contains a hardening agent.

EXAMPLES

The present invention will be explained below in more detail based on examples.

Example 1

In the apparatus of FIG. 1, as the excitation sources 6*a* and 6*b*, marketed electromagnetic vibration exciters (Model VG 100 produced by Bokusui Brown K.K.) were used, and as the heating means 8, a far infrared heater was used. Both the diameters of the vibrating free revolving rolls 5*a* and 5*b* were 30 mm, and the diameters of the non-vibrating free revolving rolls 7*a* and 7*b* were 70 mm and 100 mm respectively. The contact lengths of the reinforcing fiber bundles 2 with the respective rolls 5*a*, 5*b*, 7*a* and 7*b* were 25 mm, 40 mm, 100 mm and 150 mm respectively. All the rolls were satin-finished at 10 S on the surfaces. As the reinforcing fiber bundles 2, 50 carbon fiber bundles [Torayca (registered trade name) M40JB-3K (each consisting of 3,000 filaments) produced by Toray Industries, Inc.] were used, and the running speed was set at 0.04 m/s. The surface temperature of the heater was set at 257° C. so that the temperature of the carbon fiber bundles might be 77° C., the softening point of the sizing agent used.

The vibrating free revolving rolls 5*a* and 5*b* were vibrated respectively at a vibration frequency of 8 Hz at an amplitude of 10 mm, and as a result, the carbon fiber bundles were opened at an opening degree of 4. The opening degree was calculated from the following formula:

Opening degree=Width of each carbon fiber bundle on the free revolving roll 9 at the outlet of the carbon fiber bundle opening apparatus/Width of the carbon fiber bundle on the wound package 1.

Even if the carbon fiber bundles were driven to run for a long time, fuzzing little occurred. The result of opening of Example 1 is shown in Table 1.

Example 2

The vibrating free revolving roll 5*a* was set at a vibration frequency of 8 Hz and at an amplitude of 10 mm. The vibrating free revolving roll 5*b* was set at a vibration frequency of 16 Hz at an amplitude of 20 mm. The other conditions were set as in Example 1.

As a result of opening under the above-mentioned conditions, the degree of opening was 4.5 as shown in Table 1. It can be understood that when the vibration frequency and amplitude of the vibrating free revolving roll 5*b* were increased, the opening effect became 1 mm larger than that in Example 1.

Comparative Example 1

Figure 6:
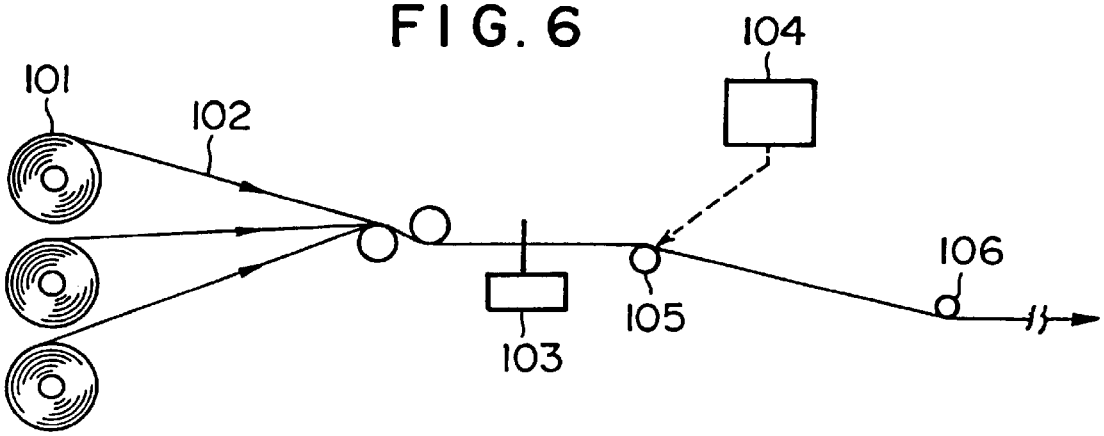
FIG. 6 is a schematic view of a conventional reinforcing fiber bundle opening apparatus.

In the conventional apparatus shown in FIG. 6, the vibrating free revolving roll 105 had an outer diameter of 30 mm, and the contact length with the carbon fiber bundles was kept at 10 mm. The vibration frequency was set at 8 Hz and the amplitude was set at 10 mm. The non-vibrating free revolving roll 106 (FIG. 6) had a diameter of 20 mm. No heating means was used. The other conditions were set as in Example 1.

As a result of opening under these conditions, the degree of opening was 2 as shown in Table 1. It can be understood that when the conventional method and apparatus were used, the opening effect became small compared to Examples 1 and 2.

TABLE 1

| | Opening conditions | | | | | | | | | | |
|---|---|---|---|---|---|---|---|---|---|---|---|
| | (1) Vibrating roller (free revolving) | | | | | | (2) Non-vibratinh roller (free revolving) | | | | Effect |
| | 1st pair (5a, 105) | | | 2nd pair (5b) | | | 1st pair (7a, 106) | 2nd pair (6b) | Contact length ratio ((2)/(1)) | | Degree of opening |
| | Vibration frequency | Amplitude | Contact length | Vibration frequency | Amplitude | Contact length | Contact length | Contact length | 1st pair | 2nd pair | |
| Example 1 | 8 Hz | ○:5A(ϕ 30) 10 mm | 25 mm | 8 Hz | ○:5b(ϕ 30) 10 mm | 40 mm | ○:7a(ϕ 70) 100 mm | ○:7b(ϕ 100) 150 mm | 100/25 = 4.0 | 150/40 = 3.75 | 4 |
| Example 2 | 8 Hz | ○:5A(ϕ 30) 10 mm | 25 mm | 16 Hz | ○:5b(ϕ 30) 20 mm | 40 mm | ○:7a(ϕ 70) 100 mm | ○:7b(ϕ 100) 150 mm | 100/25 = 4.0 | 150/40 = 3.75 | 4.5 |
| Comparative Example 1 | 8 Hz | ○:105(ϕ 30) 10 mm | 10 mm | | — | | ○:106(ϕ 20) Less than 10 mm | — | 10/10 = 1.0 | — | 2 |

Example 3

The apparatus shown in FIG. 3 was used, and as the heating means 16, a far infrared heater was used. The diameters of the vibrating free revolving rolls 17 were 30 mm, and the diameters of the non-vibrating free revolving rolls 18 were 90 mm. The rolls 15, 17, 18 and 19 were satin-finished at 10 S on the surfaces. Eight pairs of the rolls 17 and 18 were set to keep the carbon fiber bundles run for distances of 60 mm without contacting the rolls. The free revolving rolls 15 had a radius of 15 mm and had 1.5 mm high ridges extending in the axial direction of each roll with an angle of 45° formed between the respectively adjacent ridges. This apparatus was used as a carbon fiber bundle opening apparatus. Forty carbon fiber bundles (Torayca (registered trade name) T700SC-12K (each consisting of 12,000 filaments) produced by Toray Industries, Inc.] were driven to run at a tension of 2 N per fiber bundle at a line speed of 0.1 m/s, and heated to 100° C., then being vibrated at an amplitude of 13 mm at a vibration frequency of 5 Hz. As a result, the degree of opening of the carbon fiber bundles was 3. Even if the carbon fiber bundles were driven to run for a long time, fuzzing little occurred.

Subsequently, the carbon fiber bundles were guided around a take-up roll with a powder brake mechanism, to increase the tension to 4 N per fiber bundle in the impregnation step.

One hundred parts by weight of Epikote 828 and Epikote 1001 (bisphenol A glycidyl ether (epoxy equivalent 189): produced by Yuka Shell Epoxy K.K.), 5 parts by weight of dicyandiamine and 5 parts by weight of 3(3,4-dichlorophenyl)-1,1-dimethylurea were homogeneously mixed to obtain a one-pack type setting epoxy resin composition. The one-pack type setting epoxy resin composition was formed into a resin film using a releasing sheet. The resin film was overlaid on the uniform and thin carbon fiber bundle sheet obtained by said carbon fiber opening apparatus, and the laminate was fed between hot rolls, for impregnation, to prepare a prepreg with a fiber content of 70 wt % and an areal unit fiber weight of 50 g/m$^2$. The prepreg obtained was free from cracking and uniform.

Example 4

Carbon fiber bundles were opened as described for Example 1, except that the carbon fiber bundles were driven to run at a speed of 0.4 m/s and vibrated at an amplitude of 25 mm and at a frequency of 23 Hz. The degree of opening was 2.4. Even if the carbon fiber bundles were driven to run for a long time, fuzzing little occurred. Furthermore, the prepreg obtained was free from cracking and good in grade.

Comparative Example 2

Carbon fiber bundles were opened as described for Example 1, except that the diameters of the vibrating free revolving rolls were 100 mm. Fuzzing occurred due to abrasion. The carbon fiber bundle sheet was used to prepare a prepreg with a fiber content of 70 wt % and an areal unit fiber weight of 50 g/m$^2$. The prepreg obtained was not good in surface grade.

Comparative Example 3

Carbon fiber bundles were opened as described for Example 1, except that the diameters of the non-vibrated free revolving rolls were 30 mm. The degree of opening was 1.3, to show that the opening effect was small. The carbon fiber bundle sheet was used in an attempt to prepare a prepreg with a fiber content of 70 wt % and an areal unit fiber weight of 50 g/m$^2$. Cracking occurred continuously, and no prepreg could be obtained.

Comparative Example 4

Carbon fiber bundles were opened as described for Example 1, except that the distance between each of the vibrating free revolving rolls and its mating non-vibrating free revolving roll in which the carbon fiber bundles did not contact the rolls were set at 150 mm. The degree of opening was 1.2, to show that the opening effect was small.

Industrial Applicability

When the reinforcing fiber bundle opening method and apparatus according to the present invention are used for opening reinforcing fiber bundles, the fiber bundles can be opened stably with little fuzzing even if the reinforcing fiber bundles remain twisted, and a uniform and thin reinforcing fiber sheet can be obtained. Furthermore, the prepreg manufacturing method according to the present invention allows a crack-less uniform and thin prepreg with a good grade to be obtained. The uniform and thin prepreg with a good grade can be widely used as a general industrial material such as aircraft material or automobile material demanded to be thinner and lighter in weight in recent years, and also as a medical material or a material to be formed for sports and leisure applications such as fishing rods, golf club shafts, badminton rackets and tennis rackets.

What is claimed is:

1. A method for opening a reinforcing fiber bundle, in which a reinforcing fiber bundle consisting of a plurality of paralleled single fibers is driven to run through a plurality of rolls while being bent, comprising (a) vibrating at least one of the plurality of rolls in the axial direction of the roll, (b) pressing the reinforcing fiber bundle to the peripheral surface of a roll located immediately downstream of the vibrating roll without vibrating the roll, and (c) bringing the reinforcing fiber bundle into contact with the peripheral surface of the non-vibrating roll with a contact length of less than twice the contact length of the reinforcing fiber bundle on the peripheral surface of the vibrating roll.

2. The method for opening a reinforcing fiber bundle according to claim 1, wherein a plurality of mutually paralleled reinforcing fiber bundles respectively consisting of a plurality of paralleled single fibers are used instead of said one reinforcing fiber bundle.

3. The method for opening a reinforcing fiber bundle according to claim 1, wherein the contact length of the reinforcing fiber bundle in contact with the peripheral surface of the non-vibrating roll is kept in a range of 2 to 10 times the contact length of the reinforcing fiber bundle on the peripheral surface of the vibrating roll.

4. The method for opening a reinforcing fiber bundle according to claim 1, wherein the reinforcing fiber bundle is heated to soften the sizing agent deposited in the reinforcing fiber bundle.

5. The method for opening a reinforcing fiber bundle according to claim 4, wherein the reinforcing fiber bundle is heated in a range of 50 to 180° C.

6. The method for opening a reinforcing fiber bundle according to claim 5, wherein the reinforcing fiber bundle is heated in a range of 70 to 140° C.

7. The method for opening a reinforcing fiber bundle according to claim 1, wherein the vibrating roll is vibrated at a vibration frequency of 1 to 100 Hz at an amplitude of 1 to 50 mm.

8. The method for opening a reinforcing fiber bundle according to claim 7, wherein the vibrated roll is vibrating at a vibration frequency of 3 to 60 Hz at an amplitude of 1 to 30 mm.

9. The method for opening a reinforcing fiber bundle according to claim 1, wherein two or more pairs of rolls, each pair consisting of said vibrating roll and said non-vibrating roll, are provided, and the plurality of vibrating rolls are set at respectively different values in at least either vibration frequency or amplitude.

10. The method for opening a reinforcing fiber bundle according to claim 9, wherein the number of the plurality of vibrating rolls is n, and the n vibrating rolls are equal in vibration frequency and are shifted in the phase of vibration by 360/n° each.

11. The method for opening a reinforcing fiber bundle according to any one of claims 1 through 10, wherein the reinforcing fiber bundle is a carbon fiber bundle.

12. A method for opening a reinforcing fiber bundle, in which a reinforcing fiber bundle consisting of a plurality of paralleled single fibers is driven to run through a plurality of rolls while being bent, comprising arranging 2 to 10 pairs of rolls, each pair consisting of a vibrating free revolving roll vibrated in the axial direction of the roll and a non-vibrating free revolving roll, with the diameters of the vibrating free revolving rolls in the respective pairs kept in a range of 20 to 50 mm, the diameters of the non-vibrating free revolving rolls kept in a range of 50 to 120 mm, and the distance between each of the vibrating free revolving rolls and its mating non-vibrating free revolving roll kept in a range of 10 to 100 mm as the length of the reinforcing fiber bundle segment not in contact with either of the rolls, and letting the reinforcing fiber bundle run around the vibrating free revolving rolls and the non-vibrating free revolving rolls alternately.

13. The method for opening a reinforcing fiber bundle according to claim 12, wherein a plurality of mutually paralleled reinforcing fiber bundles respectively consisting of a plurality of paralleled single fibers are used instead of said one reinforcing fiber bundle.

14. The method for opening a reinforcing fiber bundle according to claim 12, wherein the vibrating free revolving rolls are vibrated in a vibration frequency range of 1 to 100 Hz in an amplitude range of 1 to 50 mm.

15. The method for opening a reinforcing fiber bundle according to claim 14, wherein the vibrating free revolving rolls are vibrated in a vibration frequency range of 3 to 60 Hz and in an amplitude range of 1 to 30 mm.

16. The method for opening a reinforcing fiber bundle according to claim 12, wherein the reinforcing fiber bundle is driven to run at a speed of 0.08 to 0.50 m/s.

17. The method for opening a reinforcing fiber bundle according to claim 12, wherein the reinforcing fiber bundle is heated to soften the sizing agent deposited in the reinforcing fiber bundle.

18. The method for opening a reinforcing fiber bundle according to claim 17, wherein the reinforcing fiber bundle is heated in a range of 50 to 180° C.

19. The method for opening a reinforcing fiber bundle according to claim 18, wherein the reinforcing fiber bundle is heated in a range of 70 to 140° C.

20. The method for opening a reinforcing fiber bundle according to claim 12, wherein a free revolving roll with a plurality of ridges extending in the axial direction of the roll on the surface is provided upstream and/or downstream of the vibrating free revolving rolls, to control the reinforcing fiber bundle in the movement in the axial direction of the roll.

21. The method for opening a reinforcing fiber bundle according to claim 12, wherein the plurality of vibrating free revolving rolls are respectively independently changed in amplitude and vibration frequency, for adjusting the opened width of the reinforcing fiber bundle.

22. The method for opening a reinforcing fiber bundle according to claim 12, wherein the number of the plurality of vibrated free revolving roll is n, and the n vibrated rolls are equal in vibration frequency and are shifted in the phase of vibration by 360/n° each.

23. The method for opening a reinforcing fiber bundle according to any one of claims 12 to 22, wherein the reinforcing fiber bundle is a carbon fiber bundle.

24. An apparatus for opening a reinforcing fiber bundle, which has a plurality of rolls through which a reinforcing fiber bundle consisting of a plurality of paralleled single fibers is driven to run while being bent, and an exciting means for vibrating at least one of the plurality of rolls in the axial direction of the roll, comprising (a) a roll located immediately downstream of the vibrating roll vibrated by said exciting means, not being vibrated, and (b) said non-vibrating roll, having a peripheral surface with the contact length of not less than twice the contact length of the reinforcing fiber bundle on the peripheral surface of the vibrating roll.

25. The apparatus for opening a reinforcing fiber bundle according to claim 24, wherein a plurality of mutually paralleled reinforcing fiber bundles respectively consisting of a plurality of paralleled single fibers are used instead of said one reinforcing fiber bundle.

26. The apparatus for opening a reinforcing fiber bundle according to claim 24, wherein the contact length of the reinforcing fiber bundle on the peripheral surface of the non-vibrating roll is in a range of 2 to 10 times the contact length of the reinforcing fiber bundle on the peripheral surface of the vibrating roll.

27. The apparatus for opening a reinforcing fiber bundle according to claim 24, wherein a heating means for heating the reinforcing fiber bundle is provided.

28. The apparatus for opening a reinforcing fiber bundle according to claim 24, wherein two or more pairs of rolls, each pair consisting of said vibrating roll and said non-vibrating roll are provided, and adjusting means are provided for allowing the plurality of the vibrating rolls to be set at respectively different values in at least either vibration frequency or amplitude.

29. The apparatus for opening a reinforcing fiber bundle according to claim 28, wherein the number of the plurality of vibrating rolls is n, and the n vibrated rolls are equal in vibration frequency and can be shifted in the phase of vibration by 360/n° each.

30. The apparatus for opening a reinforcing fiber bundle according to any one of claims 24 through 29, wherein the reinforcing fiber bundle is a carbon fiber bundle.

31. An apparatus for opening a reinforcing fiber bundle, which has a plurality of rolls through which a reinforcing fiber bundle consisting of a plurality of paralleled single fibers is driven to run while being bent, comprising (a) said plurality of rolls, being 2 to 10 pairs of rolls, each pair consisting of a vibrating free revolving roll vibrated in the axial direction of the roll and a non-vibrating free revolving roll, and (b) the diameters of the vibrating free revolving rolls in the respective pairs, being kept in a range of 20 to 50 mm, the diameters of the non-vibrating free revolving rolls, being kept in a range of 50 to 120 mm, and the distance between each of the vibrating free revolving rolls and its mating non-vibrating free revolving roll, being kept in a range of 10 to 100 mm as the length of the reinforcing fiber bundle segment not in contact with either of the rolls.

32. The apparatus for opening a reinforcing fiber bundle according to claim 31, wherein a plurality of mutually paralleled reinforcing fiber bundles respectively consisting of a plurality of paralleled single fibers are used instead of said one reinforcing fiber bundle.

33. The apparatus for opening a reinforcing fiber bundle according to claim 31, wherein a heating means for heating the reinforcing fiber bundle is provided.

34. The apparatus for opening a reinforcing fiber bundle according to claim 31, wherein a free revolving roll with a plurality of ridges extending in the axial direction of the roll on the surface is provided upstream and/or downstream of the vibrating free revolving rolls.

35. The apparatus for opening a reinforcing fiber bundle according to claim 34, wherein the height (t) of the ridges of the free revolving roll with ridges on the surface is larger than $r(1/\cos(\theta/2)-1)$, where r is the radius of the roll, and the angle ($\theta$) formed between the respectively adjacent ridges in reference to the axial center of the roll is kept in a range of 10 to 50°.

36. The apparatus for opening a reinforcing fiber bundle according to claim 31, wherein adjusting means for allowing the plurality of vibrating free revolving rolls to be changed respectively independently in amplitude and vibration frequency are provided.

37. The apparatus for opening a reinforcing fiber bundle according to claim 31, wherein the number of the plurality of vibrating free revolving rolls is n, and the n vibrating rolls are equal in vibration frequency and can be shifted in the phase of vibration by 360/n° each.

38. The apparatus for opening a reinforcing fiber bundle according to claim 31, wherein at least either the vibrating free revolving rolls or the non-vibrating free revolving rolls are satin-finished in a surface roughness range of 3 S to 20 S on the surfaces.

39. The apparatus for opening a reinforcing fiber bundle according to any one of claims 31 through 38, wherein the reinforcing fiber bundle is a carbon fiber bundle.

40. A method for manufacturing a prepreg in which ac reinforcing fiber bundle consisting of a plurality of paralleled single fibers is driven to run through a plurality of rolls while being bent, to be opened, and the opened reinforcing fiber bundle is impregnated with a resin, comprising (a) vibrating at least one of the plurality of rolls in the axial direction of the roll for opening the reinforcing fiber bundle, (b) pressing the reinforcing fiber bundle to the peripheral surface of the roll located immediately downstream of the vibrating roll without vibrating the roll, (c) bringing the reinforcing fiber bundle into contact with the peripheral surface of the non-vibrating roll with a contact length of not less than twice the contact length of the reinforcing fiber bundle on the peripheral surface of the vibrating roll, for retaining the opened state of the reinforcing fiber bundle, and (d) impregnating the reinforcing fiber bundle with the opened state retained, with a resin.

41. The method for manufacturing a prepreg according to claim 40, wherein a plurality of mutually paralleled reinforcing fiber bundles respectively consisting of a plurality of paralleled single fibers are used instead of said one reinforcing fiber bundle.

42. The method for manufacturing a prepreg according to claim 40, wherein the contact length of the reinforcing fiber bundle in contact with the peripheral surface of the non-vibrating roll is in a range of 2 to 10 times the contact length of the reinforcing fiber bundle on the peripheral surface of the vibrating roll.

43. The method for manufacturing a prepreg according to claim 40, wherein the reinforcing fiber bundle is heated to soften the sizing agent deposited in the reinforcing fiber bundle.

44. The method for manufacturing a prepreg according to claim 40, wherein two or more pairs of rolls, each pair consisting of said vibrating roll and said non-vibrating roll are provided, and the plurality of vibrating rolls are set at respectively different values in at least either vibration frequency or amplitude.

45. The method for manufacturing a prepreg according to claim 44, wherein the number of the plurality of vibrating rolls is n, and the n vibrating rolls are equal in vibration frequency and are shifted in the phase of amplitude by 360/n° each.

46. The method for manufacturing a prepreg according to claim 40, wherein the tension applied to the reinforcing fiber bundle is increased after the reinforcing fiber bundle is opened.

47. The method for manufacturing a prepreg according to any one of claims 40 through 46, wherein the reinforcing fiber bundle is a carbon fiber bundle.

48. The method for manufacturing a prepreg, in which a reinforcing fiber bundle consisting of a plurality of single fibers is driven to run through a plurality of rolls while being bent, to be opened, and impregnated with a resin, comprising (a) arranging 2 to 10 pairs of rolls, each pair consisting of a vibrating free revolving roll vibrated in the axial direction of the roll and a non-vibrating free revolving roll, with the diameters of the vibrating free revolving rolls in the respective pairs kept in a range of 20 to 50 mm, with the diameters of the non-vibrating free revolving rolls kept in a range of 50 to 120 mm, and with the distance between each of the vibrating free revolving rolls and its mating non-vibrating free revolving roll kept in a range of 10 to 100 mm as the length of the reinforcing fiber bundle segment not in contact with either of the rolls, and letting the reinforcing fiber bundle run through the vibrating free revolving rolls and the non-vibrating free revolving rolls alternately, for opening the reinforcing fiber bundle, and (b) impregnating the opened reinforcing fiber bundle with a resin.

49. The method for manufacturing a prepreg according to claim 48, wherein a plurality of mutually paralleled reinforcing fiber bundles respectively consisting of a plurality of paralleled single fibers are used instead of said one reinforcing fiber bundle.

50. The method for manufacturing a prepreg according to claim 48, wherein the vibrating free revolving rolls are vibrated in a vibration frequency range of 1 to 100 Hz and in an amplitude range of 1 to 50 mm.

51. The method for manufacturing a prepreg according to claim 48, wherein the reinforcing fiber bundle is heated to soften the sizing agent deposited in the reinforcing fiber bundle.

52. The method for manufacturing a prepreg according to claim 48, wherein a free revolving roll with a plurality of ridges extending in the axial direction of the roll on the surface is provided upstream and/or downstream of the vibrating free revolving rolls, to control the reinforcing fiber bundle in the movement in the axial direction of the roll by the free revolving roll with ridges.

53. The method for manufacturing a prepreg according to claim 48, wherein the plurality of vibrating free revolving rolls can be respectively independently changed in amplitude and vibration frequency, to adjust the opened width of the reinforcing fiber bundle.

54. The method for manufacturing a prepreg according to claim 48, wherein the number of the plurality of vibrating free revolving rolls is n, and the n vibrating rolls are equal in vibration frequency and are shifted in the phase of vibration by 360/n° each.

55. The method for manufacturing a prepreg according to claim 48, wherein the tension applied to the reinforcing fiber bundle is increased after the reinforcing fiber bundle is opened.

56. The method for manufacturing a prepreg according to any one of claims 48 through 55, wherein the reinforcing fiber bundle is a carbon fiber bundle.

* * * * *

UNITED STATES PATENT AND TRADEMARK OFFICE

CERTIFICATE OF CORRECTION

PATENT NO.: 6,094,791
DATED: August 1, 2000
INVENTOR(S): Daisaku Akase, Hidetaka Matsumae, Tohru Hanano and Toshihide Sekido It is certified that error appears in the above-identified patent and that said Letters Patent is hereby corrected as shown below:

In Column 3, line 5, please change "900" to --90°--.

In Column 19, line 16, please change "ac" to --a--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*